US010149529B1

(12) United States Patent
Turner

(10) Patent No.: US 10,149,529 B1
(45) Date of Patent: Dec. 11, 2018

(54) ULTIMATE HAIR STAND SYSTEM AND METHOD

(71) Applicant: LaToya Turner, Lansing, MI (US)

(72) Inventor: LaToya Turner, Lansing, MI (US)

( * ) Notice: Subject to any disclaimer, the term of this patent is extended or adjusted under 35 U.S.C. 154(b) by 0 days.

(21) Appl. No.: 15/193,464

(22) Filed: Jun. 27, 2016

(51) Int. Cl.

| | |
|---|---|
| ***A45D 44/14*** | (2006.01) |
| ***A45D 44/04*** | (2006.01) |
| ***A45D 44/02*** | (2006.01) |
| ***A45D 8/00*** | (2006.01) |
| ***F16M 11/28*** | (2006.01) |
| ***F16M 11/04*** | (2006.01) |
| ***F16M 11/24*** | (2006.01) |
| *F16M 11/36* | (2006.01) |
| *F16M 11/34* | (2006.01) |
| *A45D 2/00* | (2006.01) |

(52) U.S. Cl.
CPC ..... *A45D 44/14* (2013.01); *A45D 8/00* (2013.01); *A45D 44/02* (2013.01); *A45D 44/04* (2013.01); *F16M 11/041* (2013.01); *F16M 11/242* (2013.01); *F16M 11/28* (2013.01); *A45D 2002/005* (2013.01); *A45D 2008/002* (2013.01); *F16M 11/046* (2013.01); *F16M 11/245* (2013.01); *F16M 11/34* (2013.01); *F16M 11/36* (2013.01); *F16M 2200/021* (2013.01); *F16M 2200/028* (2013.01)

(58) Field of Classification Search
CPC .... F16M 11/046; F16M 11/245; F16M 11/28; F16M 11/16; F16M 11/36; F16M 11/34; A45D 44/04; A45D 44/14; A45D 2002/005; A45D 2024/002; A45D 44/02; A45D 2008/002; A45D 8/00; A45D 2020/126; A47F 7/065; A47F 5/02; A47F 5/06; A47F 7/00
USPC ..... 248/122.1, 125.8, 157, 163.1, 170, 171, 248/176.1, 188.6; 211/13.1, 33
See application file for complete search history.

(56) References Cited

U.S. PATENT DOCUMENTS 1,517,825 A * 12/1924 Bruneau ..... F16M 11/34 248/171
2,194,800 A * 3/1940 Ley ..... F16B 7/1472 24/278

(Continued)

FOREIGN PATENT DOCUMENTS

WO WO-2015041356 A1 * 3/2015 ..... A41G 5/0046

*Primary Examiner* — Jonathan Liu
*Assistant Examiner* — Taylor L Morris
(74) *Attorney, Agent, or Firm* — Loomis, Ewert, Parsley, Davis & Gotting PC; Mikhail Murshak

(57) ABSTRACT

An ultimate hair stand system for holding hairpieces for styling and dressing. The stand includes an extension, a base, and a rack. The extension has a height adjustment assembly including a height lock, with the height adjustment assembly configured to lockably adjust between a plurality of heights. The base has an anti-skid surface, with the anti-skid surface configured to limit lateral movement of the base across a floor, and the base is further configured to statically position the height adjustment assembly on the floor. The rack is a hairpiece rack configured to removably hold a plurality of hairpieces, and further configured to couple to the height adjustment assembly. For portability, the extension, the base, and the rack can be unassembled and be removably-inserted in the box of a travel case and transported to a desired location by use of an adjustable strap.

15 Claims, 4 Drawing Sheets

(56) References Cited

U.S. PATENT DOCUMENTS 2,592,186 A * 4/1952 Ratliff ..... A45D 44/04 211/88.01
2,613,901 A * 10/1952 Tatar ..... G10G 5/00 248/167
2,864,577 A * 12/1958 Du Mais ..... F16M 11/245 248/171
3,658,283 A * 4/1972 Martin ..... A45D 44/14 223/66
4,871,074 A * 10/1989 Bryson ..... A45D 20/12 211/26
5,072,910 A * 12/1991 May ..... F16M 11/28 248/170
5,503,312 A 4/1996 Kassner
5,509,629 A * 4/1996 Sassmannshausen ..... F16M 11/16 248/169
5,564,661 A * 10/1996 Gershon ..... A47B 19/002 248/167
5,586,696 A 12/1996 Martinez
5,630,517 A * 5/1997 Maznik ..... A45D 20/12 211/70.6
5,741,336 A * 4/1998 Fraser ..... A41G 3/0033 132/53
5,964,524 A * 10/1999 Qian ..... F21V 21/06 248/170
6,227,387 B1 * 5/2001 Rose ..... A47J 47/16 211/113
6,375,135 B1 * 4/2002 Eason ..... F16M 11/16 248/163.1
6,581,890 B2 * 6/2003 Johnson ..... A45D 44/04 248/161
6,601,813 B1 * 8/2003 Kager ..... A45D 20/12 248/288.31
6,644,601 B2 * 11/2003 Aussiker ..... H02G 1/14 248/125.8
6,913,230 B2 * 7/2005 Wells ..... A45D 44/02 248/127
7,028,853 B1 * 4/2006 Simms ..... A45D 8/00 211/126.2
7,159,728 B2 * 1/2007 Smith ..... A45D 44/14 211/115
7,703,725 B2 4/2010 May
7,712,614 B2 * 5/2010 Carlson ..... B62H 3/02 211/22
7,775,377 B2 * 8/2010 Abney ..... A45D 44/06 211/13.1
7,828,254 B2 * 11/2010 Stephens-De Alanis ..... A45D 44/00 211/30
8,141,827 B2 * 3/2012 Lin ..... F16M 11/242 248/170
8,322,666 B2 * 12/2012 Duemmel ..... A45B 11/00 248/163.1
8,439,210 B1 5/2013 Griffith
8,807,064 B2 * 8/2014 Yang ..... A63F 11/0051 116/222
8,950,591 B1 * 2/2015 McDowell ..... A45D 44/14 211/13.1
8,998,002 B1 * 4/2015 Milner ..... A47F 7/065 211/13.1
2005/0081759 A1 * 4/2005 Snead ..... A45D 29/00 108/25
2006/0008780 A1 1/2006 Pang
2006/0011787 A1 * 1/2006 Law ..... A47J 37/0786 248/121
2006/0086869 A1 * 4/2006 Hsieh ..... F16M 11/046 248/171
2008/0078914 A1 4/2008 Liao
2009/0008347 A1 * 1/2009 Bell ..... A45D 44/02 211/61
2009/0056730 A1 * 3/2009 Wilson ..... A61F 2/10 132/53
2009/0218376 A1 9/2009 King et al.
2011/0114805 A1 * 5/2011 Ye ..... F16M 11/046 248/122.1
2013/0192626 A1 * 8/2013 Cohen ..... A45D 8/00 132/275
2014/0191634 A1 * 7/2014 Smiley ..... A47F 7/065 312/209
2015/0230589 A1 * 8/2015 Davidson ..... A45D 44/14 223/66
2015/0257515 A1 9/2015 Bernard
2015/0285428 A1 * 10/2015 Duperron ..... F16M 11/041 248/163.1
2016/0220011 A1 * 8/2016 Minato ..... A41G 5/0046

* cited by examiner

ULTIMATE HAIR STAND SYSTEM AND METHOD

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of hair styling tools and more specifically relates to an ultimate hair stand system.

2. Description of Related Art

Hairpieces, wigs, and hair extensions are used by many people for a variety of reasons. Hairpieces and wigs are used to conceal baldness, to alter a person's appearance such as might be required for an actor portraying a character, or as a fashion accessory. Hair extensions are used to supplement someone's existing hair to add length, fullness, or a different hair texture.

It is important to maintain the proper hygiene of hairpieces, wigs, and hair extensions to prevent irritation to the wearer and to maintain the aesthetically-pleasing appearance of the hair piece, wig, or hair extensions. To shampoo a hairpiece, wig, or loose hair extensions, a person may hold the item in one hand and apply the shampoo or other cleansing agent with the other hand. After cleaning, the hairpiece, wig, or loose hair extensions are combed while holding them one hand. This process is inefficient and uncomfortable and it is very difficult to use hair styling tools while holding the hairpiece, wig, or loose hair extensions in one hand. In a home home, a user may devise an arrangement for holding the wig for washing and styling, but in other situations, for example in a guestroom or a hotel, cleaning and styling of the hair piece, wig, or loose hair extensions Is a challenge. A suitable solution is desired.

Several attempts have been made to solve the above-mentioned problems such as those found in U.S. Pat. and Pub. Nos. 7,703,725 to May; U.S. Pat. No. 5,503,312 to Kassner; U.S. Pat. No. 5,586,696 to Martinez; U.S. Pat. No. 8,439,210 to Griffith; 2006/0008780 to Pang; 2008/0078914 to Liao; 2009/0218376 to King et al.; and 2015/0257515 to Bernard. This art is representative of hair styling tools. However, none of the above inventions and patents, taken either singly or in combination, is seen to describe the invention as claimed.

BRIEF SUMMARY OF THE INVENTION

In view of the foregoing disadvantages inherent in the known hair styling tool art, the present invention provides a novel ultimate hair stand system. The general purpose of the present invention, which will be described subsequently in greater detail is to provide a stand to hold a hairpiece for styling.

An ultimate hair stand system is disclosed herein, in a preferred embodiment, comprising portable system for holding hairpieces during styling. The portable system may include the stand and have the extension, the base, and the rack, which in an unassembled condition are configured to be removably-inserted in the box of a travel case and transported to a desired location by use of an adjustable strap.

The extension may be configured as concentric tubes. The extension may further be configured as a telescopic unit having a minimum height and a maximum height. The extension may have a height adjustment assembly including a height lock. The height adjustment assembly may be configured to lockably adjust between a plurality of heights. The extension may include a push-button lock that may be configured to lockably adjust between a plurality of heights by pushing the push-button lock of an inner tube and slidably extending or retracting the inner tube until the push-button lock extends out of one of a plurality of holes of the outer tube. The extension may move between the minimum height and the maximum height, manually, by the user with no use of tools. The extension further includes a base receiver and a rack receiver. The base receiver and the rack receiver are removably-coupleable with the extension. The extension may be moved to the minimum height for stowage in the box of a travel case.

The base may be configured to statically position the height adjustment assembly on a floor. The base includes legs, the legs having anti-skid surface and the legs are configured to fold, collapse, and lock as desired by a user. The base may further have an anti-skid surface, with the anti-skid surface configured to limit lateral movement of the base across a floor. The base may be configured to have a deployed state and a retracted state. The retracted state may be smaller than the deployed state. The legs are held in a splayed condition with an adjustment screw for use and held in a stowed condition for stowage in the box of the travel case.

The hairpiece rack may be configured to removably hold a plurality of hairpieces. The rack may be configured with a hole such that a screw can be inserted through the hole and be removably-attached to the outer tube. The rack may be configured as a rail such that at least one hair extension may be slidably-attachable to the rail and the at least one hair extension may be serially positioned next to another at least one hair piece. The rack may be further configured to couple to the height adjustment assembly. Further, the rack may be removed from the outer tube for stowage in the box of the travel case. The rack may be configured to release the hairpiece for stowage of the rack in the box of the travel case.

A method of retaining the hairpieces during styling may be adjusting the rack having the height adjustment assembly, hanging at least one section of a hair extension on the rack, and removing the at least one section of a hair extension from the rack when styling is complete Where retaining the at least one hair extension retention on the rack includes grasping the fabric strip of the at least one hair extension and slidably-attaching it to the rail and the at least one hair extension may be slidably-removed when styling may be complete.

According to another embodiment, a method for using an ultimate hair stand system is also disclosed herein. The method for providing ultimate hair stand system includes the steps of: unpacking the rack, the base, and the extension from the box of a travel case; deploying the rack, when attaching the rack follows deployment of the extension; and unpacking and deploying the legs by extending and holding the legs in a splayed condition with the adjustment screw.

The present invention holds significant improvements and serves as an ultimate hair stand system. Preferably, a hair styling tool should provide a stand to hold a hairpiece for styling and, yet would operate reliably and be manufactured at a modest expense. Thus, a need exists for a reliable ultimate hair stand system to avoid the above-mentioned problems.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present disclosure, ultimate hair stand system, constructed and operative according to the teachings of the present disclosure.

The various embodiments of the present invention will hereinafter be described in conjunction with the appended drawings, wherein like designations denote like elements.

DETAILED DESCRIPTION

Figure 1:
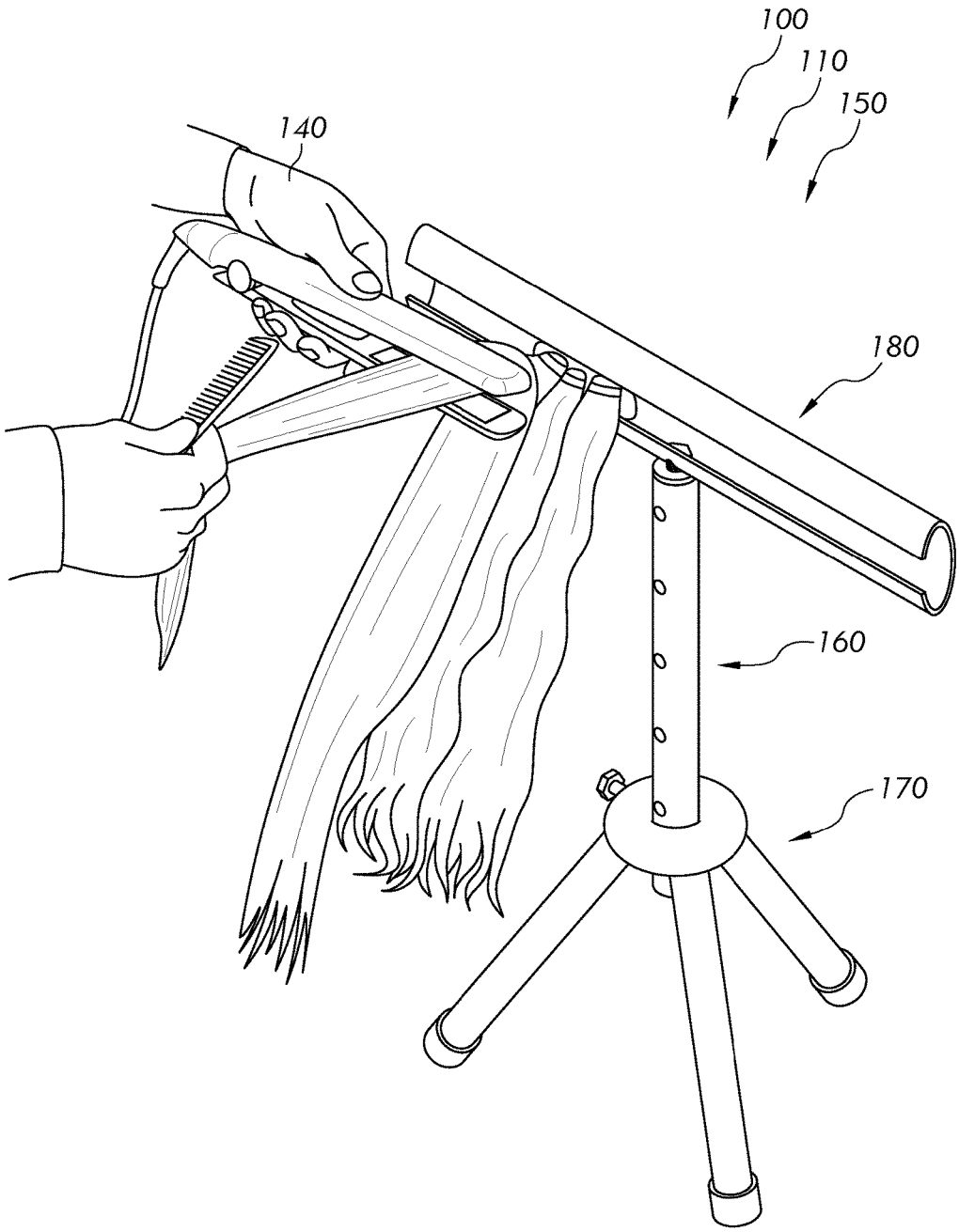
FIG. 1 shows a perspective view illustrating an ultimate hair stand system during an 'in-use' condition according to an embodiment of the disclosure.

As discussed above, embodiments of the present disclosure relate to hair styling tools and more particularly to an ultimate hair stand system as used to improve stands to hold a hairpiece for styling.

Generally speaking, ultimate hair stand systems may comprise an apparatus used to hold hair extensions, hair bundles and/or wigs. It enables a user to freely style the hairpieceswith both hands because the hairpieces hang from a standing clamp. The user may blow dry, flat iron, or curl the hair piece. The device is made up of four components with an optional fifth component. The bar clamp is an elongated butterfly-style clamp that holds the hair extension or hair bundle. This allows the hair to spread out so that the user can cater to smaller sections of the hairpiece at a time. The outer pole is combined with the main pole and gives the stand an adjustable height so that the user can utilize it in any capacity, whether sitting or standing. It has multiple pin holes to allow for an appropriate height. The inner pole locks into the outer pole to secure height for the stand. The tripod base attaches to the inner pole and stabilizes with an adjustable pin screw the inner pole slides inside the outer main pole until the push pin clicks into one of the height-adjusting pin holes, securing it in place. The bar clamp screws on to the main outer pole as well. The base is a standard tripod with rubber tips to give the stand sturdy support. The ultimate hair stand is simple to assemble and no tools are required.

The present invention, has as its principal object to provide a stand for holding a hairpiece at an elevated position to assist in cleaning and dressing of the hairpiece. Further objects of the present invention are that the stand holds hair extensions or wigs at an elevated position for cleaning and styling; the stand height is adjustable; the stand is compact and portable and has a case to enclose and carry the stand; and the stand is economical to manufacture.

Referring now more specifically to the drawings by numerals of reference there is shown in FIGS. 1-4, various views of an ultimate hair stand system. Ultimate hair stand system may be portable system 100 for holding hairpieces for user 140 during and 'in-use' condition to style hairpieces. Portable system 100 stand 110 may include extension 160, base 170, and rack 180. Extension 160, base 170, and rack 180, in an unassembled condition are configured to be removably-inserted in box 201 of travel case 200 and transported to a desired location by use of adjustable strap 202.

In continuing to refer to FIGS. 1-4, extension 160 may be configured as concentric tubes 163. Extension 160 may be configured as a telescopic unit having a minimum height and a maximum height. Extension 160 may be configured to manually move between a minimum height and a maximum height by user 140 and with no use of tools. Extension 160 may be moved to the minimum height for stowage in the box 201 of the travel case 200. Extension 160 may further have height adjustment assembly 161 including height lock 162. Height adjustment assembly 161 may be configured to lockably adjust between a plurality of heights. Further, extension 160 may include push-button lock 164 that may be configured to lockably adjust between the plurality of heights by pushing push-button 164 lock of inner tube 165 and slidably extending or retracting inner tube 165 until push-button lock 164 extends out of one of plurality of holes 167 of outer tube 166. Base 170 further includes an extension receiver 190 and extension 160 includes a rack receiver 191. Extension receiver 190 and rack receiver 191 are removably-coupleable with extension 160.

Base 170 may be configured to statically position height adjustment assembly 161 on a floor. Base 170 includes legs 171. Legs 171 have anti-skid surface 172 and are configured to fold, collapse, and lock as desired by user 140. Base 170 may further have anti-skid surface 172, with anti-skid surface 172 configured to limit lateral movement of base 170 across a floor. Base 170 may be configured to have a deployed state and a retracted state. The retracted state may be smaller than the deployed state. Legs 171 are held in a deployed splayed condition with adjustment screw 173 for use, and in a stowed condition for stowage in box 201 of travel case 200.

Figure 2:
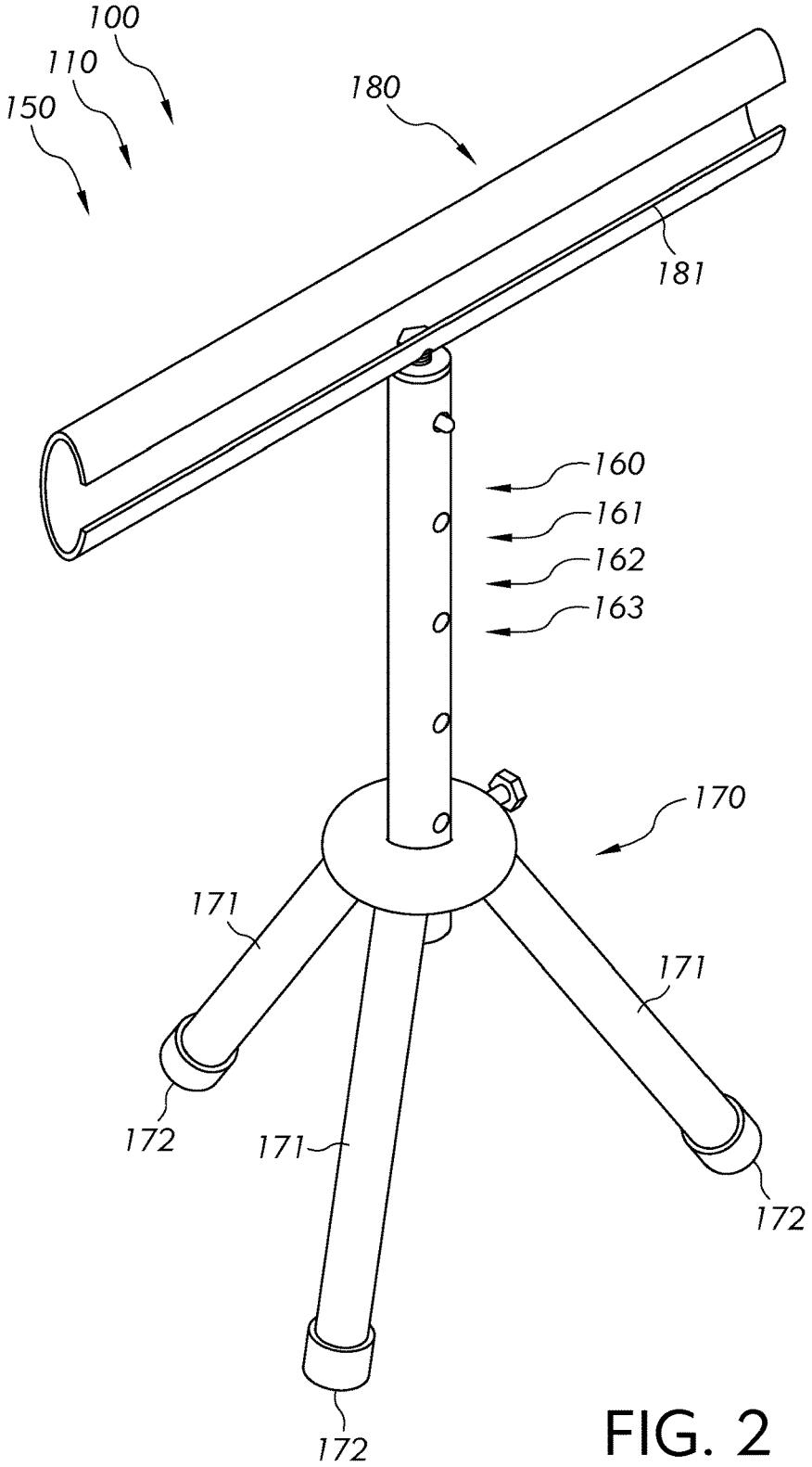
FIG. 2 is a perspective view illustrating the ultimate hair stand system comprising a stand assembly according to an embodiment of the present invention of the disclosure.
Figure 3:
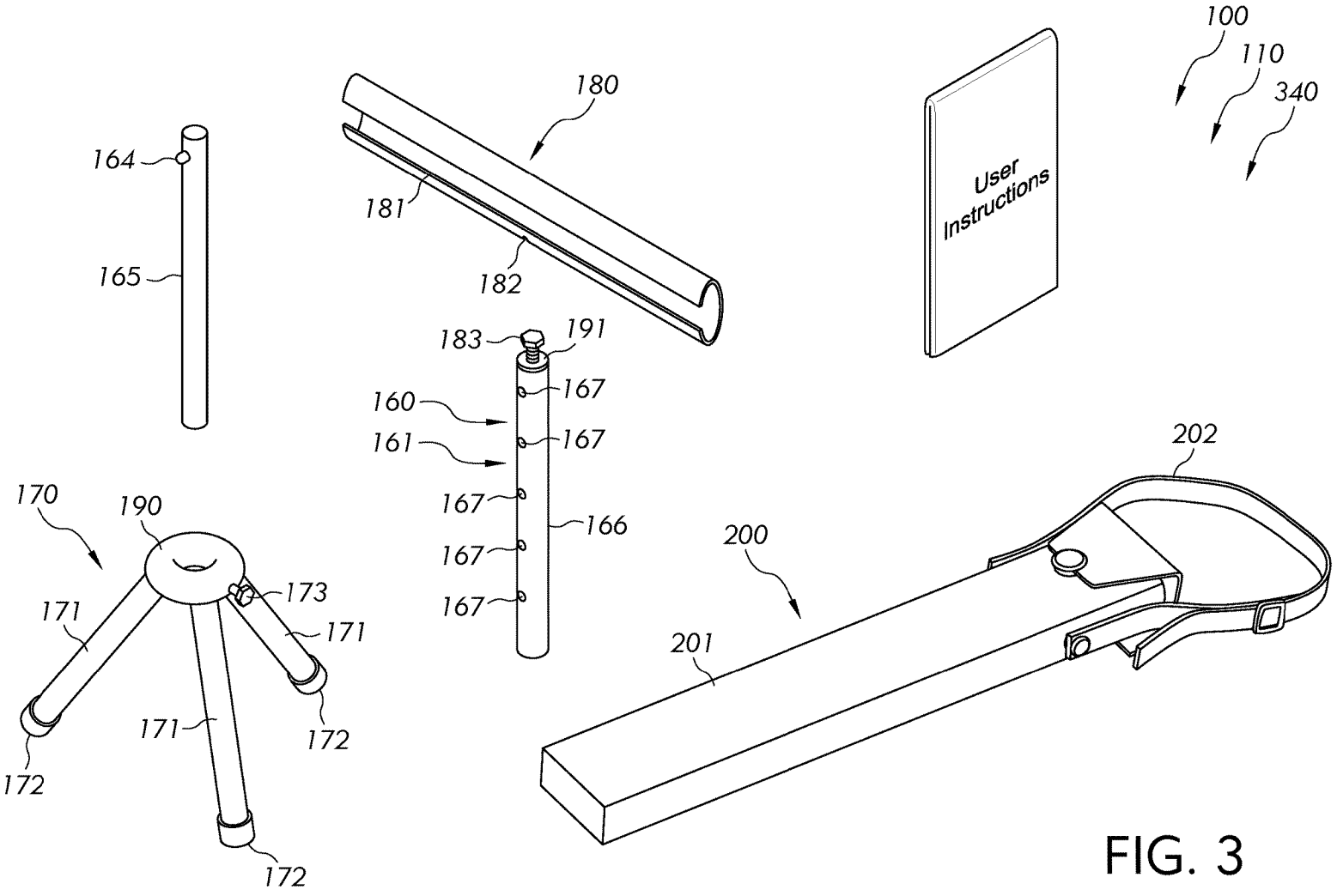
FIG. 3 is an exploded perspective view illustrating ultimate hair stand system according to an embodiment of the present disclosure.
Figure 4:
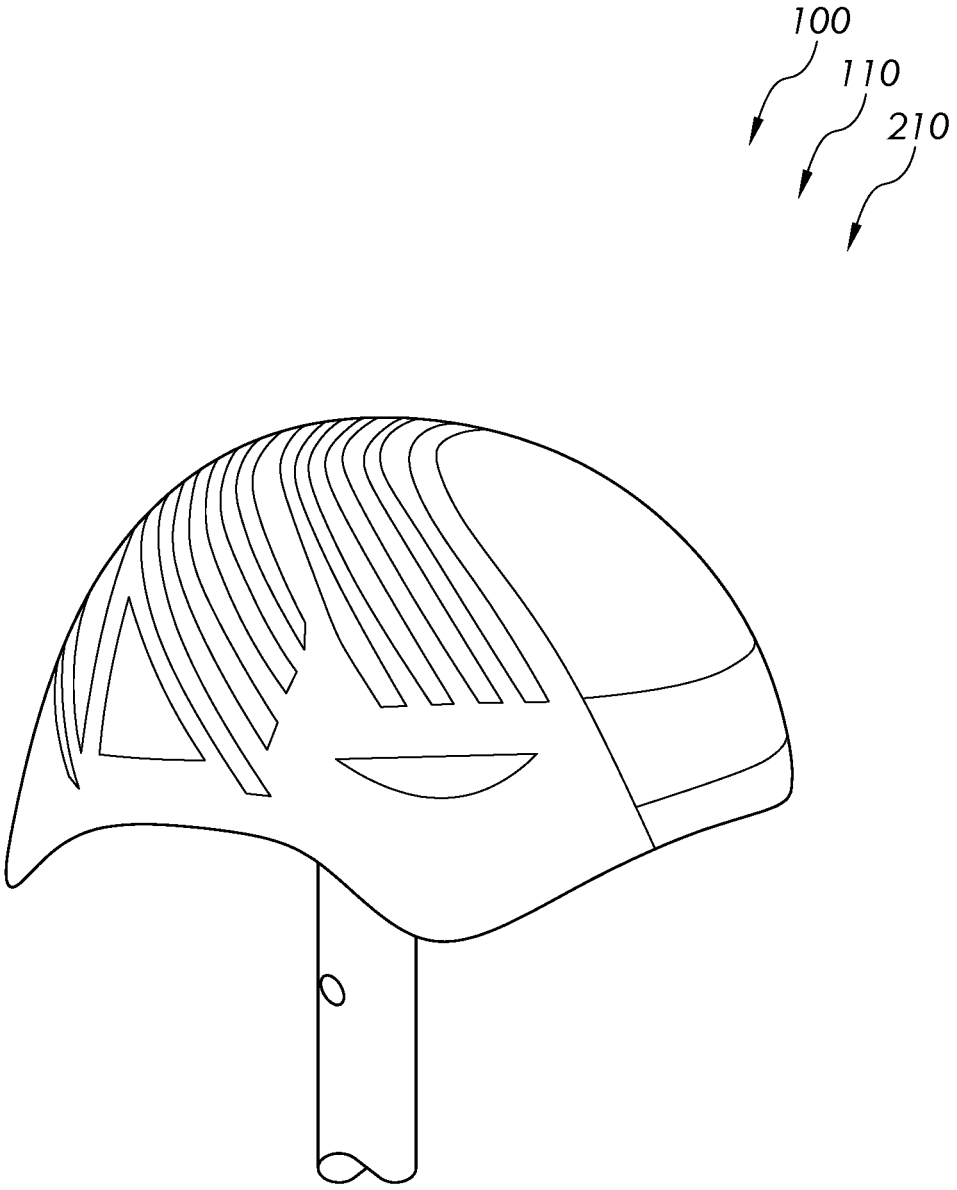
FIG. 4 is a perspective view illustrating stand assembly according to an alternate embodiment of the present disclosure.

Hairpiece rack 180 may be configured to removably hold a plurality of hairpieces. The plurality of hairpieces may be a hairpiece, a wig, and alternately at least one section of a hair extension 160. Rack 180 may be configured with hole 182 such that screw 183 can be inserted through hole 182 thus be removably-attached to outer tube 166. Rack 180 may further be configured as rail 181 such that at least one hair extension may be slidably attachable to rail 181 and the at least one hair extension may be serially positioned next to another at least one hair piece. The rail 181 extends along a length of the rack 180 which defines a C-shaped cross section resulting in a C-channel. Rack 180, as shown in FIGS. 1-3, defines an opening for receiving the hairpiece, the opening extending the length of the rack 180. The C-channel is sized and shaped to receive the hairpiece and secure it in place. The rail 181 formed in the C-channel allows for the hairpiece to be adjusted slidably along the length of the rack within the opening. Rack 180 may be further configured to couple to height adjustment assembly 161. Rack 180 may be configured to release the hairpiece, the wig, and alternately the at least one section of a hair extension for stowage of rack 180 in box 201 of travel case 200. Further, rack 180 may be removed from outer tube 166 for stowage in box 201 of travel case 200.

A method of retaining the hairpieces during styling may be adjusting rack 180 which includes height adjustment assembly 161, hanging at least one section of a hair extension on rack 180, and removing the at least one section of a hair extension 160 from rack 180 when styling is complete, where retaining the at least one hair extension retention on rack 180 includes grasping the fabric strip of the at least one hair extension and slidably-attaching it to rail 181. The at least one hair extension may be slidably-removed when styling is complete. The method may further include retaining the hairpiece and alternatively the wig on alternative embodiment of rack 210 (FIG. 4) of the present disclosure. Alternative embodiment of rack 210 may be able to be removably-attached to extension 160, and the hairpiece and alternatively the wig may be placed on alternative embodiment of the rack 210 and the hairpiece and the wig may be removed from the alternative embodiment of the rack 210 when desired. Upon reading this specification, it should be appreciated that, under appropriate circumstances, considering such issues as user preferences, design preference, structural requirements, marketing preferences, cost, available materials, technological advances, etc., other ultimate hair stand system arrangements such as clips to hold hair, plastic materials for construction, etc., may be sufficient.

Portable system 100 may be sold as a kit 340 comprising the following parts: at least one extension 160; at least one base 170; at least one rack 180; and at least one set of user instructions. The kit has instructions such that functional relationships are detailed in relation to the structure of the invention (such that the invention can be used, maintained, or the like in a preferred manner).

Portable system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color and height combinations, parts may be sold separately, etc., may be sufficient.

A method of use for portable system 100 may comprise the steps of: step one, unpacking rack 180, base 170, and extension 160 from box 201 of travel case 200; step two, deploying rack 180, when attaching rack 180 follows deployment of extension 160; and step three, unpacking and deploying legs 171 by extending and holding legs 171 in a splayed condition with adjustment screw 173.

It should be noted that the steps described in the method of use can be carried out in many different orders according to user preference. The use of "step of" should not be interpreted as "step for", in the claims herein and is not intended to invoke the provisions of 35 U.S.C. § 112 (f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A stand for holding hairpieces for styling, the stand comprising:

an extension having a height adjustment assembly including a height lock, the height adjustment assembly configured to lockably adjust between a plurality of heights;

a base having an anti-skid surface, said anti-skid surface configured to limit lateral movement of the base across a floor, the base configured to statically position the height adjustment assembly on the floor; and a rack having a hairpiece rack defining a C-shaped cross section forming a C-channel removably holding at least one hairpiece in place within an opening of the C-channel, and further configured to couple to the height adjustment assembly; wherein said C channel forms a rail extending a length of said rack such that the at least one hairpiece is slidably-attachable to said rail and adjustable along the length of said rack within said rail.

2. The stand of claim 1 wherein said base includes [[a]] an extension receiver and said extension includes a rack receiver wherein said extension receiver is removably-coupleable to said extension.

3. The stand of claim 2 wherein said base is configured to have a deployed state and a retracted state wherein said retracted state is smaller than said deployed state.

4. The stand of claim 3 wherein said base includes legs, said legs having anti-skid surface and are configured to collapse, and lock as desired by a user.

5. The stand of claim 1 wherein said extension is configured as a telescopic unit having a minimum height and a maximum height.

6. The stand of claim 5 wherein said extension is configured as concentric tubes wherein said extension is configured to move between said minimum height and said maximum height by said user manually with no use of tools.

7. The stand of claim 6 wherein said height lock includes a push-button lock formed on an inner tube of said extension; said push-button lock is configured to lockably adjust between a plurality of heights by pushing said push-button lock of said inner tube and slidably extending or retracting said inner tube until said push-button lock extends out of one of a plurality of holes of an outer tube.

8. The stand of claim 1 wherein said at least one hairpiece is serially positioned next to another at least one hairpiece, wherein said hairpieces are slidably adjustable along the length of the rack.

9. The stand of claim 8 wherein said rack is configured with a hole such that a screw can be inserted through said hole and be removably-attached to said height adjustment assembly.

10. The stand of claim 1 wherein said rack is configured to retain a wig[[,]] and alternately at least one section of a hair extension.

11. A portable system for holding hairpieces during styling, the portable system comprising the stand of claim 1, wherein said extension, said base, and said rack in an unassembled condition are configured to be removably-inserted in a box of a travel case and transported to a desired location by use of an adjustable strap.

12. The system of claim 11 wherein said base includes legs held in a splayed condition with an adjustment screw for use and the adjustment screw allows for the legs to collapse to be in a stowed condition for stowage in said box of said travel case.

13. The system of claim 11 wherein said extension is moved to a minimum height for stowage in said box of said travel case.

14. The system of claim 11 wherein said rack is removed from said height adjustment assembly for stowage in said box of said travel case.

15. The system of claim 11 wherein said rack is configured to release said at least one hair piece, a wig, and alternately at least one section of a hair extension for stowage of said rack in said box of said travel case.

* * * * *